US006237865B1

(12) United States Patent
Luttermann et al.

(10) Patent No.: US 6,237,865 B1
(45) Date of Patent: May 29, 2001

(54) APPARATUS FOR SCREENING AND/OR CRUSHING SCREEN MATERIALS

(75) Inventors: Erich Luttermann, Nordhorn; Josef Többen, Meppen; Hendrikus Fransen, Twist, all of (DE)

(73) Assignee: Neuenhauser Maschinenbau GmbH & Co. KG, Neuenhaus (DE)

( * ) Notice: Subject to any disclaimer, the term of this patent is extended or adjusted under 35 U.S.C. 154(b) by 0 days.

(21) Appl. No.: 09/329,816

(22) Filed: Jun. 10, 1999

(30) Foreign Application Priority Data

Jun. 20, 1998 (DE) ..... 298 11 073 U

(51) Int. Cl.[7] ..... B02C 13/20

(52) U.S. Cl. ..... 241/101.72; 241/101.742; 241/189.1; 241/191

(58) Field of Search ..... 241/101.72, 189.1, 241/101.742, 605, 191, 236

(56) References Cited

U.S. PATENT DOCUMENTS

| | | | | |
|---|---|---|---|---|
| 4,597,703 | * | 7/1986 | Bartolini | 241/101.76 X |
| 5,042,727 | * | 8/1991 | Plante | 241/101.72 |
| 5,405,092 | * | 4/1995 | Jonninen | 241/27 |
| 5,431,350 | * | 7/1995 | Purser | 241/101.72 |
| 5,887,810 | * | 3/1999 | Maruyama | 241/189.1 |
| 5,901,911 | * | 5/1999 | Davis | 241/30 |

FOREIGN PATENT DOCUMENTS 93 04 186 U
1 * 7/1993 (DE) .

* cited by examiner

*Primary Examiner*—John M. Husar
(74) *Attorney, Agent, or Firm*—Henry M. Feiereisen; Ursula B. Day

(57) ABSTRACT

Apparatus for screening and/or crushing screen materials, includes a bucket articulated to an excavating machine and swingable about a horizontal rotation axis. The bucket has a back wall formed as a screening bottom and supporting screening shafts provided with screening elements, whereby the screening shafts extend transversely to the rotation axis.

10 Claims, 3 Drawing Sheets

APPARATUS FOR SCREENING AND/OR CRUSHING SCREEN MATERIALS

CROSS-REFERENCES TO RELATED APPLICATIONS

This application claims the priority of German Patent Application Serial No. 298 11 073.3, filed Jun. 20, 1998, the subject matter of which is incorporated herein by reference.

BACKGROUND OF THE INVENTION

The present invention relates, in general, to an apparatus for screening and/or crushing screen materials, and more particularly to a screen crusher for use in a bucket of an earth moving machine, with the bucket being swingable about a horizontal rotation axis and including a back wall which is formed as screening bottom and supports screening shafts provided with screening elements.

German Pat. No. DE 93 04 186 U1 describes a screen crusher for soil materials for use in the bucket of an earth moving machine or a bucket loader. The bucket has a back wall formed as crusher screen with rotating shafts which extend substantially parallel to the rotation axis of the bucket. During screening operation, the bucket is swung about its axis of rotation so that the crusher screen is aligned substantially parallel to the ground. This screen crusher suffers the drawback that the drive assemblies for rotating the shafts are mounted laterally to the bucket. The lateral structural space that is required for accommodating the drive assemblies thus forms a dead space during operation, so that, for example, upon ingress of the bucket of the screen crusher into a silo, or along a building wall, the screen material situated between the side wall of the bucket and the building wall cannot be reached. Also, the housing of the drive assemblies is exposed to substantial wear and contamination. As a consequence, fastening screws of the covering plates become nondetachable when damaged or contaminated so that the screws or the covering plates must be removed. Maintenance and inspection of the drive assemblies are therefore significantly complicated.

A further drawback of this conventional screen crusher resides in the substantial length of the shafts which are thus exposed to great forces. Shaft bearings as well as drive assemblies must therefore be designed in a very robust fashion. However, in order to prevent the screen crusher from becoming too heavy, the torque being applicable is limited. As a consequence, in particular materials that are too large to penetrate through the screen and thus are difficult to crush prevent a complete filling of the bucket in view of the danger to overload the screen crusher. Moreover, the design of this conventional screen crusher causes during screening and/or crushing operation a hurling of rocks out of the bucket in a direction parallel to the rotation axis of the bucket and towards the operator's cab when the shafts rotate. Not only can this result in damage to the operator's cab but also exposes persons to harm. Therefore, the conventional crusher screen is highly suspect with respect to safety concerns.

SUMMARY OF THE INVENTION

It is thus an object of the present invention to provide an improved apparatus for screening and/or crushing screen materials, obviating the afore-stated drawbacks.

In particular, it is an object of the present invention to provide an improved apparatus for screening and/or crushing screen materials, which produces a better screening operation at increased throughput rate.

These objects, and others which will become apparent hereinafter, are attained in accordance with the present invention by providing a bucket which is articulated to an earth moving machine and swingable about a horizontal rotation axis, with the bucket having a back wall formed as a screening bottom and supporting screening shafts provided with screening elements, whereby the screening shafts extend transversely to the rotation axis.

The arrangement of the screening shafts in transverse disposition with respect to the rotation axis of the bucket has several advantages. The shafts can be made shorter compared to conventional designs, so that significantly higher torque can be transmitted. The transverse disposition enables the arrangement of several screening shafts in a bucket, thereby realizing a more intense movement of the screen material. The more intense movement improves not only the screening result but also leads to an increase of the throughput rate. As in this type of rotary screens, the material is moved by the rotation of the screening shafts or screening elements towards the screening bottom, the transverse disposition of the shafts results also in a longer screening path compared to the conventional screen crusher.

The apparatus according to the invention is suitable for screening and/or crushing different screen material, such as, for example, excavated soil, filter cake, coal, compost, but is also applicable to separate the excavated soil from larger solid pieces, such as boulder or wood. The apparatus according to the invention can also be designed for use in a typical shovel of earth moving machines such as, e.g., wheel loaders, diggers, loaders and tractors.

According to another feature of the present invention, the screening elements may be formed by screening disks mounted on the screening shafts, and crushing members positioned between spaced-apart screening disks. This results in a structurally simple design which is easy to manufacture. The shafts are sturdy while still exhibiting a comparably lightweight structure.

According to still another feature of the present invention, the crushing members may be retained laterally in pockets of the screening disks, and each crushing member is secured by a tensioning element. An example for a suitable tensioning element includes a screw bolt. The pockets are suitably configured in a slightly conical manner or taper towards the ends. Positioned between two screening disks is a crushing member which is received in the screening disks in complementary side sections of the pockets. Thus, the crushing member is held and guided in the pockets and can be secured by means of the tensioning element.

According to still another feature of the present invention, the screw bolt may extend through the shaft and is threadably engageable from behind in an internal thread of the crushing member. By turning the screw bolt, the crushing member is drawn into the conical pockets and secured. When exchanging a crushing member, the screw bolt is loosened by a few turns, and subsequently the crushing member is ejected from the pockets by hammering onto the screw head of the bolt, and the screw bolt is then fully unscrewed. Thus, few manipulations are required to replace the crushing member in a simple and rapid fashion.

Suitably, the crushing members may be made of hard wear-resistant material. Optionally, the crushing members may have working areas that are reinforced by armoring.

According to yet another feature of the present invention, the apparatus may have screening elements with screening disks and spacers, whereby the screening disks and spacers are arranged on a screening shaft in alternating disposition.

The screening disks have a greater diameter than the spacers and form with the corresponding screening disks on the neighboring screening shafts a screening bottom which has a fineness which depends from the distance of the screening shafts and the axial distance of the screening disks.

The screening disks may have an outer contour of round, oval or polygon configuration, with a spacer being arranged between two neighboring screening disks.

The screening elements may be composed of two detachable disk segments. This is advantageous as individual screening elements may be exchanged, without requiring a dismantling of the entire screening shaft. In this context, it is possible to divide the screening disk and the spacer in individual disk segments. A disk segment of the spacer may, however, also be connected in one-piece with the respective disk segment of the screening disk. In the latter case, one screening element has only two disk segments, thereby reducing the number of components.

As already described, the crushing members of the screening elements are exchangeable. This is advantageous in particular with respect to maintenance and repair. Suitably, a crushing member is positioned between two screening disks. However, it is certainly possible to assign several crushing members to one screening element.

The crushing members may exhibit a helical shape or other suitable configuration, and be secured in spaced-apart relationship in longitudinal direction about the circumference of the screening shaft. The crushing members may also be formed as cutting strips so that the apparatus can even be used to mill material, for example, leaves, bark, on the like.

According to yet another feature of the present invention, the screening shafts may be driven at different or changeable rotational directions, individually or combined in groups. As a result, the material can be moved back and forth in the screening bucket and thus thoroughly mingled. The direction of rotation may be changed during operation, thereby further enhancing the screening result, and possibly encountered jamming can simply be eliminated. Moreover, the back and forth movement, i.e. the change of the screening direction, suppresses the expulsion of rocks through the screening shafts. In addition, the bucket includes upright side walls which are arranged, preferably, at a right angle to the bottom plate for intercepting possible rock beating in the bucket. In order to further enhance the protection of the apparatus against outward hurling of material from the bucket, it may be suitable to provide a covering plate or deflector plate at the outer longitudinal side of the bucket opening.

It may be suitable to provide the apparatus with several drive assemblies for driving the screening shafts individually or as units. As the screening shafts can be configured of short dimensions as a result of the transverse disposition with respect to the rotation axis of the bucket, high torque can be absorbed which, if needed, may be applied in a simple manner by additional drive assemblies, preferably hydraulic motors.

According to another feature of the invention, screening shafts with crushing members and without crushing members are arranged in alternating disposition. Screening shafts without crushing members operate with respect to the shafts with crushing members virtually as counter blade. In this case, it may be advantageous to provide a screening shaft without crushing members, without any drive or to keep it stationary. In this manner, the driving power is substantially reduced because, for example, only every other screening shaft needs to be driven. The apparatus can be manufactured in a cost-efficient manner while reducing the number of wearing parts at the same time.

According to yet another feature of the present invention, the outer screening shafts adjacent the side walls of the bucket have round screening elements without crushing members. As screen material may get jammed at the side walls of the bucket between the screening shaft and the side walls, it is advantageous to design the outer screening shafts without crushing members. Moreover, it is suitable to arrange at the side walls a stripping plate of sheet metal which engages between the spacer disks of the outer screening shafts so as to prevent the screen material from reaching the area between the side wall and the screening shaft.

The front edge of the bucket bottom is provided with an exchangeable cutting strip of wear-resistant material to extend the service life of the bucket. The rear part of the bottom plate is provided with accessible pillow-block bearings for the screening shafts, which are protected by a rear sheet metal cover. Arranged in the upper area of the bucket is at least one drive assembly with the required transmission elements to the screening shafts as well as a second pillow-block bearing for each screening shaft.

The drive assemblies as well as the pillow-block bearings are reliably protected and easy to access. The apparatus may be utilized as a typical shovel without any structural components projecting out laterally and exposed to damage during operation.

The apparatus according to the present invention is characterized by a robust design and ability to transmit high torque. The disposition of the screening shafts transversely to the rotation axis of the bucket ensures a longer screening path so that the screening result is improved and the throughput rate is significantly raised.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
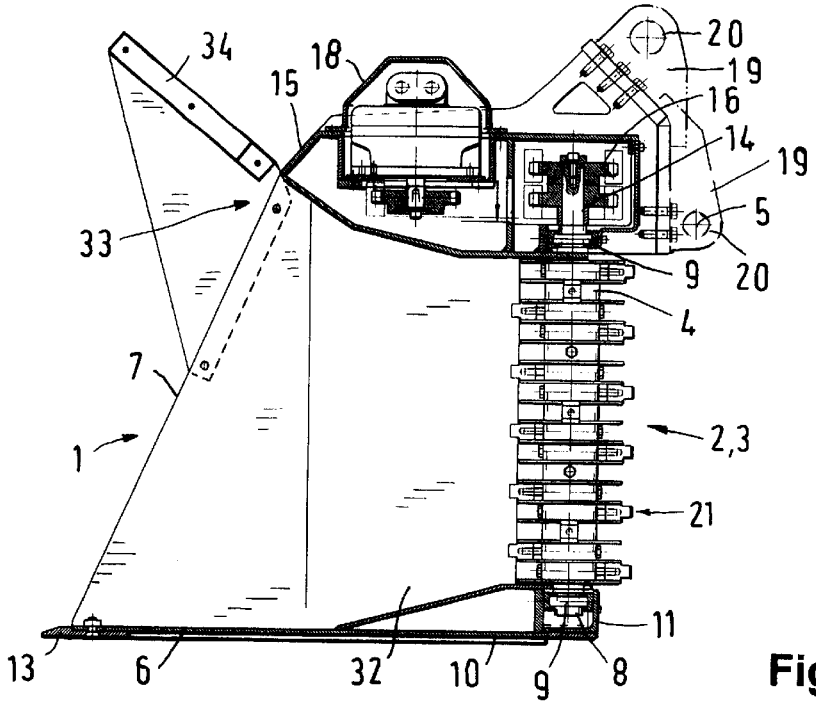
FIG. 1 is a vertical cross section of one embodiment of an apparatus for screening and/or crushing screen material, in accordance with the present invention.

Throughout all the Figures, same or corresponding elements are generally indicated by same reference numerals.

Turning now to the drawing, and in particular to FIG. 1, there is shown a vertical cross section of one embodiment of an apparatus in accordance with the present invention, for screening and/or crushing screen materials, including a bucket, generally designated by reference numeral 1 and swingably mounted to an earth moving machine or excavating machine (not shown) for rotation about a rotation axis 5. The bucket 1 has a back wall 2 so configured as to form a screening bottom 3, with the rotation axis 5 extending parallel to the screening bottom 3 in longitudinal direction of the bucket 1. The screening bottom 3 is formed by screening shafts 4 which are arranged at an angle of 90° with respect to be rotation axis 5 of the bucket 1 and are provided with screening elements, generally designated by reference numeral 21.

The bucket 1 is of a shovel-type configuration with side walls 7 arranged vertically to the back wall 2 and to a bottom plate 6. The screening shafts 4 have one end 8 secured to the bottom plate 6 by pillow-block bearings 9. The bottom plate 6 includes a hollow space 10 for accommodating the pillow-block bearings 9, with a covering plate 11 sealing the hollow space 10 on the back side thereof. The hollow space 10 is wedge-shaped in direction of a front edge 12 (FIG. 2) of the bottom plate 6, whereby a cutting strip 13 of wear-resistant material is exchangeably mounted to the front edge 12. The upper ends 14 of the screening shafts 4 project into a gearbox 15, positioned between the side walls 7, and are rotatably supported in pillow-block bearings 9, whereby double chain wheels 16 are provided in the upper ends 14.

Figure 2:
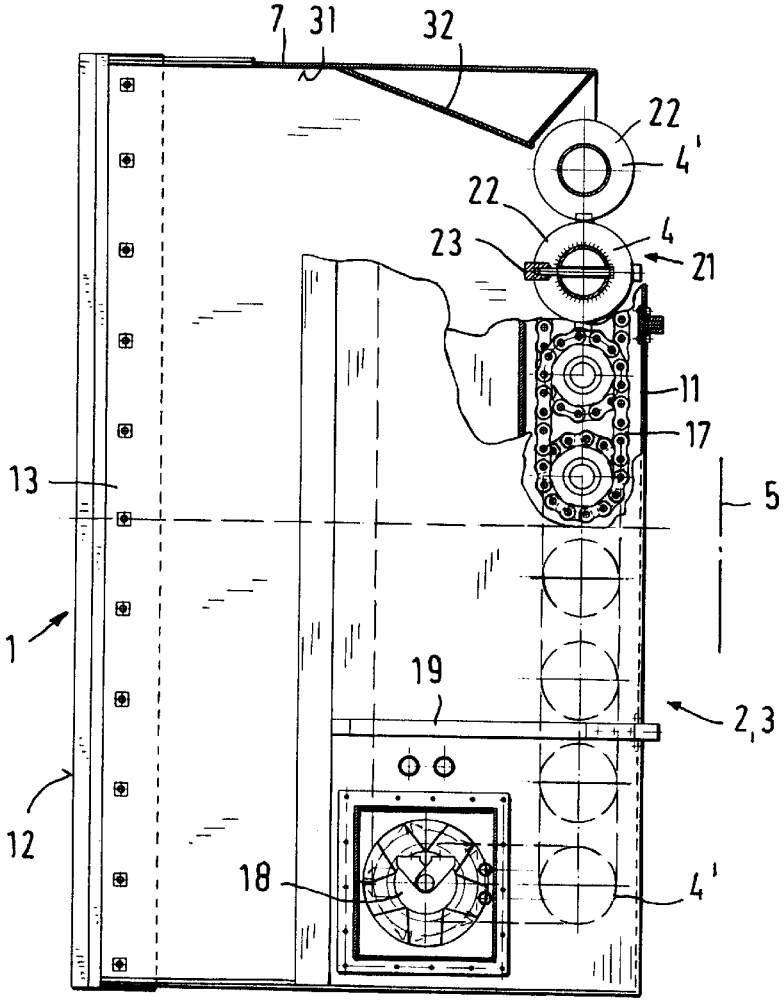
FIG. 2 is a partially sectional plan view of the apparatus of FIG. 1.

As shown in particular in FIG. 2, every two screening shafts 4 are coupled to one another via a link chain 17, and the outermost screening shafts, denoted by reference numeral 4' and positioned next to the side walls 7 of the bucket 1 are coupled via a link chain 17 to a drive assembly 18 which is fitted in the gearbox 15. For ease of illustration, FIG. 2 shows only the drive assembly 18 that is positioned in the view at the lower end, and it will be appreciated by persons skilled in the art that both drive assemblies 18 may be operated in synchronism.

Secured to the gearbox 15 are double-bracket mountings 19 for attachment to an earth moving device. The mountings 19 have bores drilled in direction of the rotation axis 5 and exhibit aligned eyelets 20.

Figure 3:
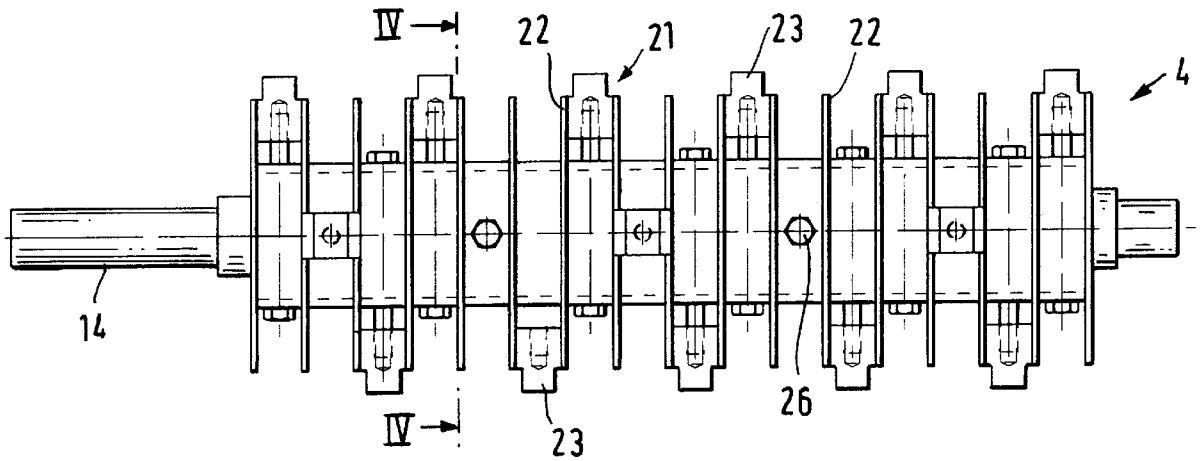
FIG. 3 is a plan view of a screening shaft.
Figure 5:
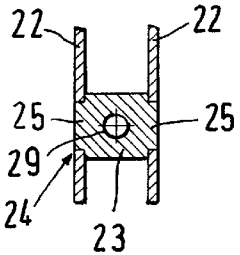
FIG. 5 is a sectional view of the apparatus, taken along the line V—V in FIG. 4.
Figure 4:
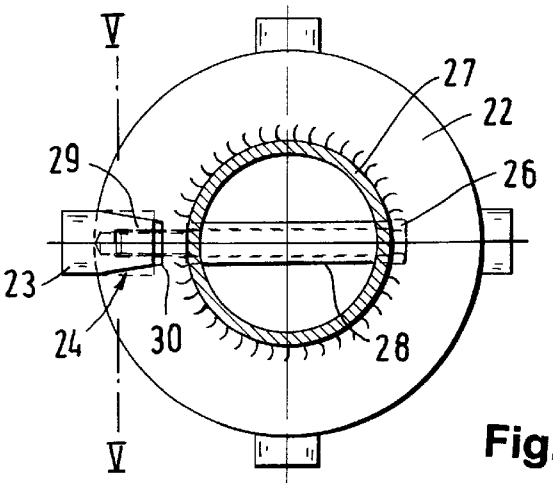
FIG. 4 is a vertical cross section of the apparatus, taken along the line IV—IV in FIG. 3.

Turning now to FIGS. 3 to 5, there are shown in more detail the configuration of an exemplified screening shaft 4 having mounted thereon a plurality of screening elements 21 which are formed by spaced-apart screening disks 22 securely welded onto the shaft 4. Positioned between the screening disks 22 are mallet-like crushing members 23 which are formed with side bars 25 (FIG. 5) for engagement in complementary lateral pockets 24 of the screening disks 22 so as to retain the crushing members 23 in place. As shown in FIG. 4, the pockets 24 are tapered towards the back in the direction of the bottom of the pockets 24. The secure placement of a crushing member 23 is realized by means of a tensioning element, for example a screw bolt 26, which is pushed through a guide sleeve 28 which traverses the hollow-cylindrical base body 27 of the screening shaft 4, and screwed into an internal thread 29 formed on the back side 30 of the crushing member 23. Thus, the crushing member 23 is drawn into the pockets 24 and secured when tightening the screw bolt 26.

As best seen in FIG. 2, the side walls 7 have inside surfaces 31 for attachment of stripping plates 32 of sheet metal by welding. The stripping plates 32 engage between the screening disks 22 of the outermost screening shafts 4' and are so disposed as to direct screen material between the outermost screening shaft 4' and the neighboring screening shaft 4. Thus, screen material is substantially prevented form reaching the area between the screening shafts 4' and the side walls 7.

FIG. 1 further shows the placement of a covering shield 34 at the upper longitudinal side 33 of the bucket 1, for protection against outwardly hurled screen material. During screening operation, the bucket 1 spins about its rotation axis 5 so that the screening bottom 3 is aligned substantially parallel to the ground. Even in situations when rocks get jammed so that rock pieces may be hurled out from the bucket 1, the covering shield 34 intercepts the trajectory of the material and thus provides an effective protection.

Figure 6:
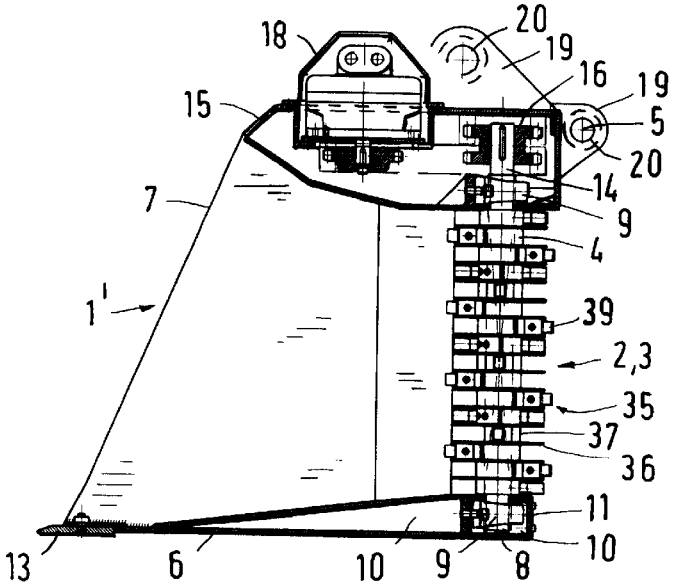
FIG. 6 is a vertical cross section of another embodiment of an apparatus for screening and/or crushing screen material, in accordance with the present invention.

Turning now to FIG. 6, there is shown a vertical cross section of another embodiment of an apparatus for screening and/or crushing screen material, in accordance with the present invention. In the following description, parts corresponding with those in FIG. 1 are denoted by same reference numerals and normally not explained again.

Figure 7:
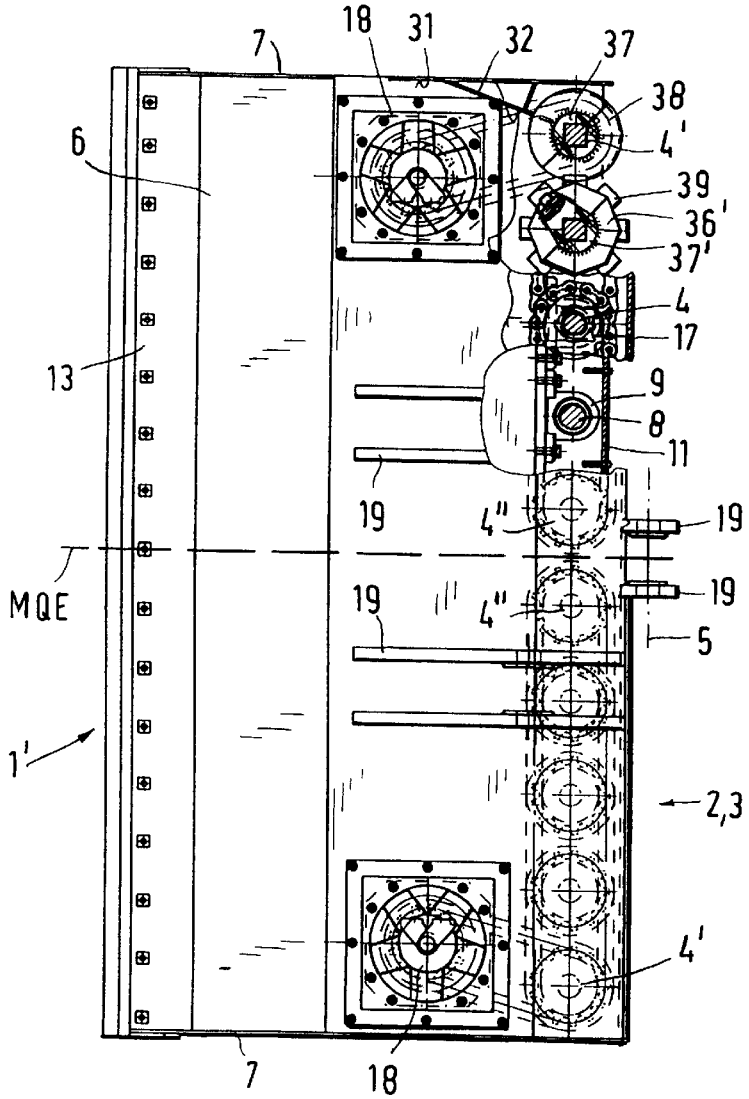
FIG. 7 is a partially sectional plan view of the apparatus of FIG. 6.

The screening bottom 3 of the bucket 1' is formed by screening shafts 4, the outermost screening shafts 4' and central screening shafts 4" positioned adjacent the central transverse plane MQE of the bucket 1', whereby the screening shafts 4, 4', 4" are arranged at an angle of 90° with respect to the rotation axis 5 of the bucket 1'. Both drive assemblies 18 are shown in FIG. 7, and are provided to rotate the screening shafts 4, 4', 4", whereby the upper drive assembly 18 is used to drive the screening shafts positioned above the central transverse plane MQE while the lower drive assembly 18 is used to drive the screening shafts positioned below the central transverse plane MQE. The central screening shafts 4" are not interconnected for transmission of power.

The screening shafts 4, 4', 4" support screening elements 35 which include screening disks 36 and spacers 37 which are of smaller diameter than the screening disks 36 but of thicker dimensions in axial direction. The spacers 37 and the screening disks 36 are arranged in alternating disposition on a screening shaft 4, 4', 4", with a spacer 37 being welded to a screening disk 36.

Such a ring-shaped screening element 35 is divided in two disk segments 38 which are screwed to one another and secured to the screening shafts 4, 4', 4". In the area of the screening elements 35, the screening shafts 4, 4', 4" have a square profile.

The screening elements 35 of the outer screening shafts 4' have a round outer profile, while the screening elements 35 of the other screening shafts 4, 4" have octagonal screening disks 36' between which a spacer 37' is respectively positioned and supports a crushing member 39. The crushing members 39 are pinned together with the respective spacers 37' and evenly spaced about the circumference of the screening shafts 4, 4". Suitably, the crushing members 39 are so arranged to engage free from collisions between two screening disks 36, 36' of the neighboring screening shafts 4, 4', 4".

The screening shafts 4, 4', 4" may be driven at different and changing rotational directions so that the material is laterally moved in the bucket and thoroughly mingled. Jamming and outward hurling of rocks is substantially eliminated by the changing rotational directions and by the provision of high side walls 7.

While the invention has been illustrated and described as embodied in an apparatus for screening and/or crushing screen materials, it is not intended to be limited to the details shown since various modifications and structural changes may be made without departing in any way from the spirit of the present invention.

What is claimed as new and desired to be protected by letters patent is set forth in the appended claims:

What is claimed is:

1. Apparatus for screening and crushing screen materials, comprising a bucket articulated to an earth moving machine and swingable about a horizontal rotation axis, said bucket having a back wall formed as a screening bottom and supporting a plurality of screening shafts, said screening shafts are provided with screening elements, said shafts are extending and rotatable transversely relative to the horizontal rotation axis.

2. The apparatus of claim 1 wherein the shafts extend substantially perpendicular to the rotation axis.

3. The apparatus of claim 1 wherein the screening elements are formed by spaced-apart screening disks mounted on the shafts and crushing members positioned between the screening disks.

4. The apparatus of claim 1 wherein each of the crushing members is retained laterally in pockets of the screening elements and secured by a tensioning element.

5. The apparatus of claim 1 wherein each of the screening elements includes screening disks mounted on the shafts, spacers positioned between the screening disks, and exchangeable crushing members supported by the spacers between the screening disks.

6. The apparatus of claim 5 wherein each of the screening elements is formed by detachable disk segments.

7. The apparatus of claim 5 wherein the bucket has side walls, said screening shafts adjacent the side walls of the bucket forming outermost screening shafts which support round screening elements devoid of crushing members.

8. The apparatus of claim 1, and further comprising drive means for driving the screening shafts, individually or combined in groups, at different and changeable direction of rotation.

9. The apparatus of claim 1 wherein a first group of screening shafts is provided with crushing members and a second group of screening shafts is devoid of crushing member, said screening shafts with crushing members and said screening shafts without crushing members being arranged in alternating disposition.

10. The apparatus of claim 1 wherein at least one screening shaft devoid of crushing member is coasting and stationary.

* * * * *